US005546778A

United States Patent [19]

Eisermann

[11] Patent Number: 5,546,778

[45] Date of Patent: Aug. 20, 1996

[54] LOCKING SYSTEM COMPOSED OF A LOCK AND SEVERAL KEYS

[75] Inventor: Armin Eisermann, Velbert, Germany

[73] Assignee: Schulte-Schlagbaum Aktiengesellschaft, Velbert, Germany

[21] Appl. No.: 335,837

[22] PCT Filed: Apr. 27, 1993

[86] PCT No.: PCT/EP93/01010

§ 371 Date: Nov. 2, 1994

§ 102(e) Date: Nov. 2, 1994

[87] PCT Pub. No.: WO93/23645

PCT Pub. Date: Nov. 25, 1993

[30] Foreign Application Priority Data

May 18, 1992 [DE] Germany ..... 42 16 421.4

[51] Int. Cl.[6] ..... E05B 47/00

[52] U.S. Cl. ..... 70/276; 70/384

[58] Field of Search ..... 70/276, 382–385, 70/413

[56] References Cited

U.S. PATENT DOCUMENTS 4,312,198 1/1982 Sedley ..... 70/276
5,074,135 12/1991 Eisermann ..... 70/276
5,267,459 12/1993 Sedley ..... 70/276

FOREIGN PATENT DOCUMENTS 0276444 8/1988 European Pat. Off. .
0304761 3/1989 European Pat. Off. .
9111583 8/1991 WIPO .
9111581 8/1991 WIPO .

*Primary Examiner*—Lloyd A. Gall
*Attorney, Agent, or Firm*—Martin A. Farber

[57] ABSTRACT

A closure system composed of a lock and several keys in which the closing of the lock, determined by magnetically controlled tumblers can be modified by a repositioning of at least one tumbler member within the lock to the code of a subsequent key, and in order to obtain a solution which is particularly advantageous with respect to construction and security, the tumbler member (33, 33') is developed as an adjusting part associated with the recoding magnet (42, 43, 44, 45, 46, 48, 49) in such a manner that the tumbler insertion opening (40, 50, 51) for the recoding magnet can be displaced out of the aligned position with respect to the recoding magnet.

5 Claims, 4 Drawing Sheets

LOCKING SYSTEM COMPOSED OF A LOCK AND SEVERAL KEYS

FIELD AND BACKGROUND OF THE INVENTION

The present invention relates to a closure system composed of a lock and several keys in which the closing of the lock, determined by magnetically controlled tumblers, can be modified in the manner that the locking code of the lock which corresponds initially to the code of the first key can be varied by the repositioning of at least one tumbler member within the lock to the code of a subsequent key, the coding being formed by individual permanent magnets which are arranged in openings in a slide and, by means of correspondingly positioned magnetization regions of a key which can be brought into a position parallel to the slide, can be lifted out to a blocking plate, whereupon the slide can be displaced into a lock-open position, a part of the permanent magnets being intended as recoding magnets.

In one known lock of the type in question, the slide receives carriers which are in toothed engagement with each other and rotatably associated with the slide, each of the carriers being provided with a recoding magnet. In this connection, provision is made so that by means of the subsequent key, the carriers having the recoding magnets can be displaced, changing the locking code. The first key is thereby cleared.

SUMMARY OF THE INVENTION

The object of the invention is to develop a lock of this type in a simple manner so that the possibilities of variation for changing the locking code are increased.

This object is achieved in a lock of the type in question in the manner that the tumbler member is developed as an adjusting part (33) seperate from the slide (10) and associated with the recoding magnet in such a way that the tumbler insertion opening for the recoding magnet is displaceable from the aligned position for the recoding magnet.

As a result of this development, an increased possibility of variation for changing the locking code is present. In order to change the locking code, the recoding magnet need not be brought now from its position into a different position. This is done rather by changing the position of the tumbler member, developed as an adjusting part, which is associated with the recoding magnet. Together with a displacement of the adjusting part, its tumbler insertion opening for the recoding magnet also comes out of the aligned position with respect to it. If, with an aligned position of the tumbler insertion opening with the recoding magnet, a key is inserted which effects a repelling of the recoding magnet in the direction towards the tumbler insertion opening, the slide cannot be displaced forward. Its displacement therefore requires a key which is so magnetized in the corresponding region that it attracts the recoding magnet, so that the latter does not enter into the tumbler insertion opening. The most different versions can be produced on this basis.

One variant is characterized by the fact that an adjusting part has several tumbler insertion openings of different diameter and/or depth. If, for instance, tumbler insertion openings of different diameter are selected, then a displacement of the recoding magnet, caused by the correspondingly magnetized key, is only possible when the tumbler insertion opening is of the same diameter as, or larger than, the corresponding recoding magnet. It is also possible to develop the recoding magnets in two parts, the length of the section of the recoding magnet associated with the adjusting part corresponding to the depth of the tumbler insertion opening.

Another alternative is characterized by the fact that at least one recoding magnet corresponds in its length to the thickness of the slide and, upon coming against the wide surface of the adjusting part, is lifted out of its blocking position with respect to the blocking plate. In such a position of the adjusting part, the slide is displaceable by means of the key—for instance a key card. However, if the adjusting part is so displaced that a tumbler insertion opening lies opposite the recoding magnet, it, the recording magnet, can, in case of corresponding magnetization of the key, enter into the insertion opening and block displacement of the slide.

In accordance with the invention, it is advantageous to develop the adjusting part as a rotary disk and to adjust the angle of rotation by means of a tool which can be inserted through the bottom surface of the lock housing. The tool is so developed on its insertion end that a form-locked coupling with the adjusting part can be produced. The different positions of angular rotation of the adjusting part can in this connection be fixed by detent engagement in order to exclude unintentional displacement of the adjusting part.

BRIEF DESCRIPTION OF THE DRAWINGS

With the above and other advantages in view, the present invention will become more clearly understood in connection with the detailed description of preferred embodiments, when considered with the accompanied drawings, of which:

FIG. 7 shows a dome and tumbler member in a variation of the embodiment of FIG. 5, the embodiment of FIG. 7 employing insertion openings of different depth.

DETAILED DESCRIPTION OF THE PREFERRED EMBODIMENTS

Figure 1:
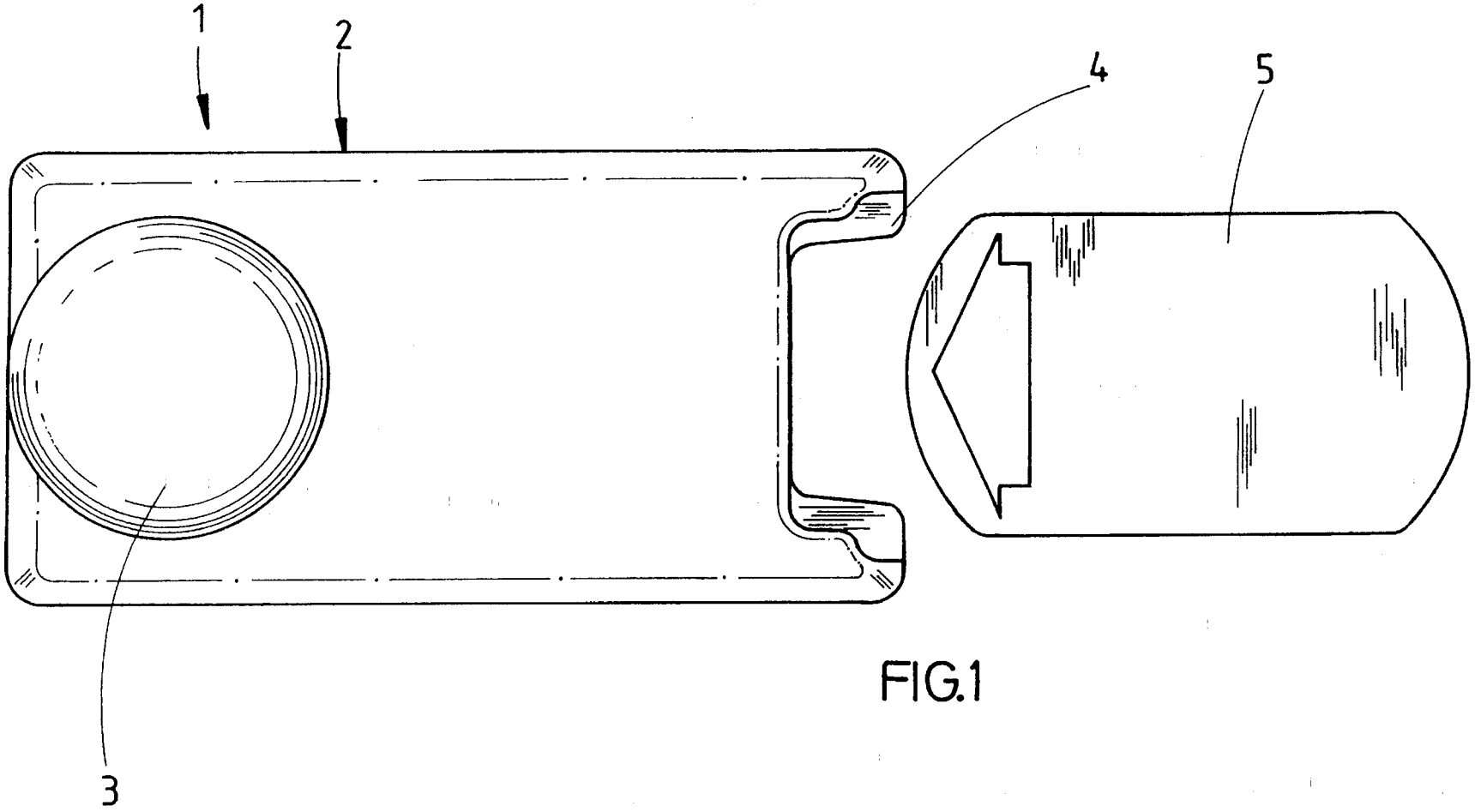
FIG. 1 is a view of a lock developed in accordance with the invention together with its key developed as a key card.

The lock 1, which can be provided for instance on the door of a hotel room, has a lock case 2 of rectangular contour which can be fastened to the outside of the door, an outside knob 3 being mounted on its one end. By means thereof, a bolt (not shown) of a mortise lock installed in the door can be withdrawn. On the other hand, the bolt can always be withdrawn from the inside of the door by means of an inside knob, not shown. An insertion slot 4 for a key 5 extends from the end of the lock case 1 opposite the outside knob 3. The key is a key card of approximately rectangular contour regions of which are magnetized.

Figure 2:
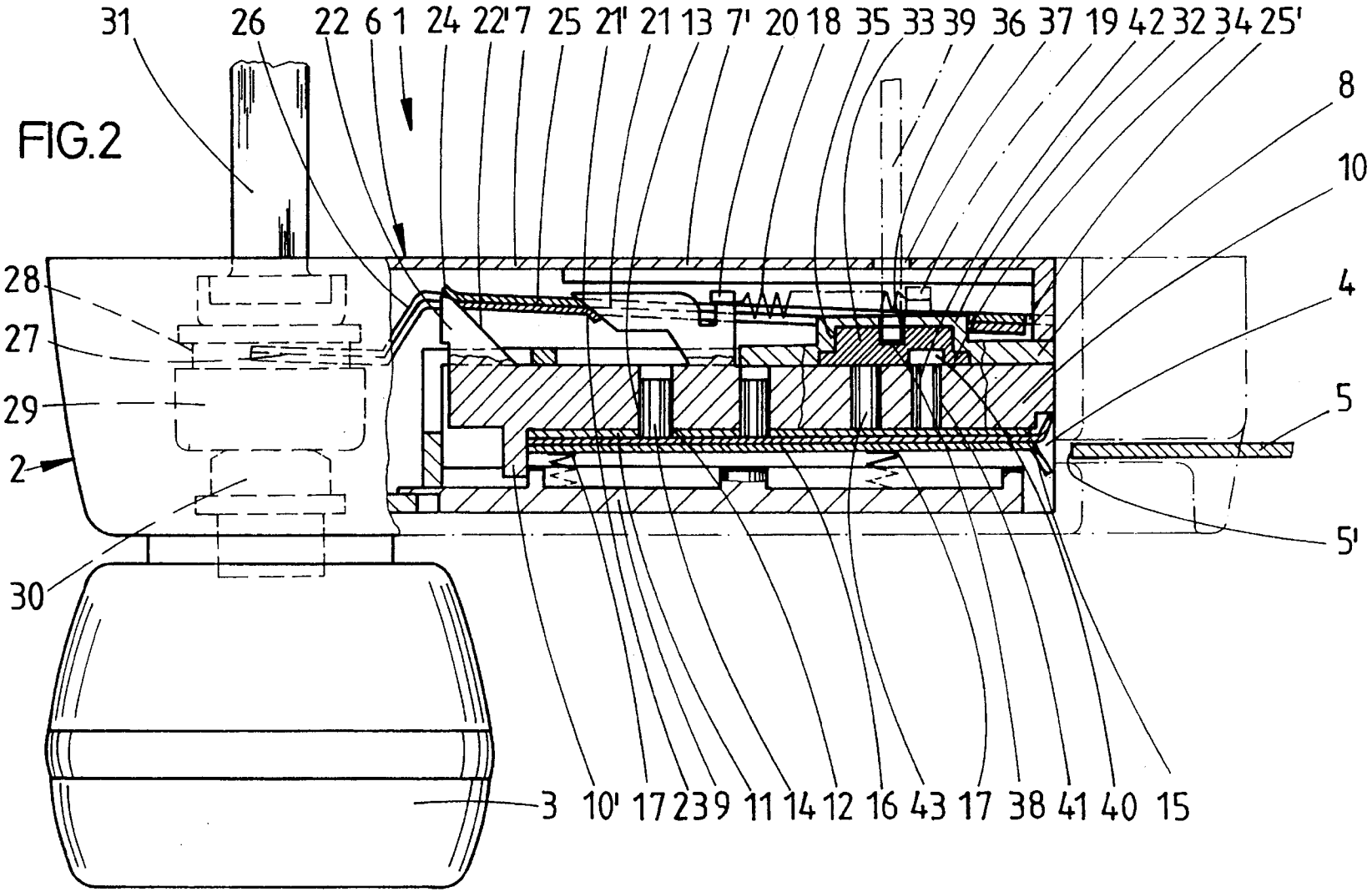
FIG. 2 shows the lock before insertion of the key, partially in side view and partially in longitudinal section.

The lock case 2 contains within it a lock housing 6 which is formed of a bottom part 7, a middle part 8, and a cover part 9. Aluminum is used for the middle part 8, while the bottom part 7 and the cover part 9 consist of plastic. The slide 10 of plate shape, which is also made of plastic, is guided between the cover part 9 and the middle part 8, it resting with one wide surface against the middle part 8. The opposite guide surface for the slide 10 is formed of a brass blocking plate 11. The latter is inserted in immovable manner in the cover part 9. Holes 12 in the blocking plate 11 coincide, in the locking position of the lock shown in FIG. 2, with holes 13 which pass through the slide 10. Magnetic tumbler pins 14 lie in said holes. It is not necessary to provide a tumbler pin 14 in each hole 13, since the number, position and polarity of the tumbler pins 14 depends on the specific opening-code combination of the lock 1.

On the other side of the blocking plate 11, there is a guide plate 15, also of brass, which, in its turn, rests against an armature plate 16. The latter is held in its position by compression springs 17 resting against the cover part 9. The armature plate 16, contrary to the other parts, consists of ferromagnetic material. Thus, the armature plate 16 attracts the magnetic tumbler pins 14, which accordingly engage into the holes 12 in the blocking plate 11. In the engaged position of the magnetic tumbler pins 14 the slide 10 cannot be moved out of its basic position. It is possible to provide a part of the holes of the slide 10 in turnable bodies (not shown) of the slide in order to be able to effect a change in the closing code by turning said turnable bodies.

Between the armature plate 16 and guide plate 15 there is left an insertion slot 4. The front transverse edges of the guide plate 15 and the armature plate 16 are bent off in opposite directions and form a gusset for the key card or key 5 which is to be inserted.

A tension spring 18 which serves as a return spring has its one end fastened to a transverse pin 19 on the middle part 8. The other end of the tension spring 18 is attached to a projection 20 on the slide 10, the projection passing through a slot in the middle part 8, by means of which spring the slide is moved into its basic position shown in FIG. 2. In front of the projection 20 there are two beveled noses 21, 22 of the slide 10 which, in the same way as the projection 20, pass through the middle part 8. The bevels 21', 22' on the noses 21, 22 are developed with approximately the same angle. They act on obliquely bent tabs 23, 24 of a rigid arm 25 which is displaceable transverse to the movement of the slide and has a spring zone 25' in the region of the insertion end for the key card. The spring zone is held in the corresponding region of the lock housing 6. The end of the arm 25 opposite the attachment end forms an offset 26 adjoining which there is fork-shaped end 27. This end engages into an annular groove 28 in an internally toothed coupling sleeve 29. In the closed position shown in FIG. 2, there is no connection for rotation between the coupling sleeve 29 and a pinion 30 which is arranged coaxial to it. Since the pinion bears the outside knob 3, only the knob can be turned, without driving the coupling sleeve along with it. The push spindle 31 which is in composite engagement with the coupling sleeve 29 is therefore not carried along with it.

Figure 3:
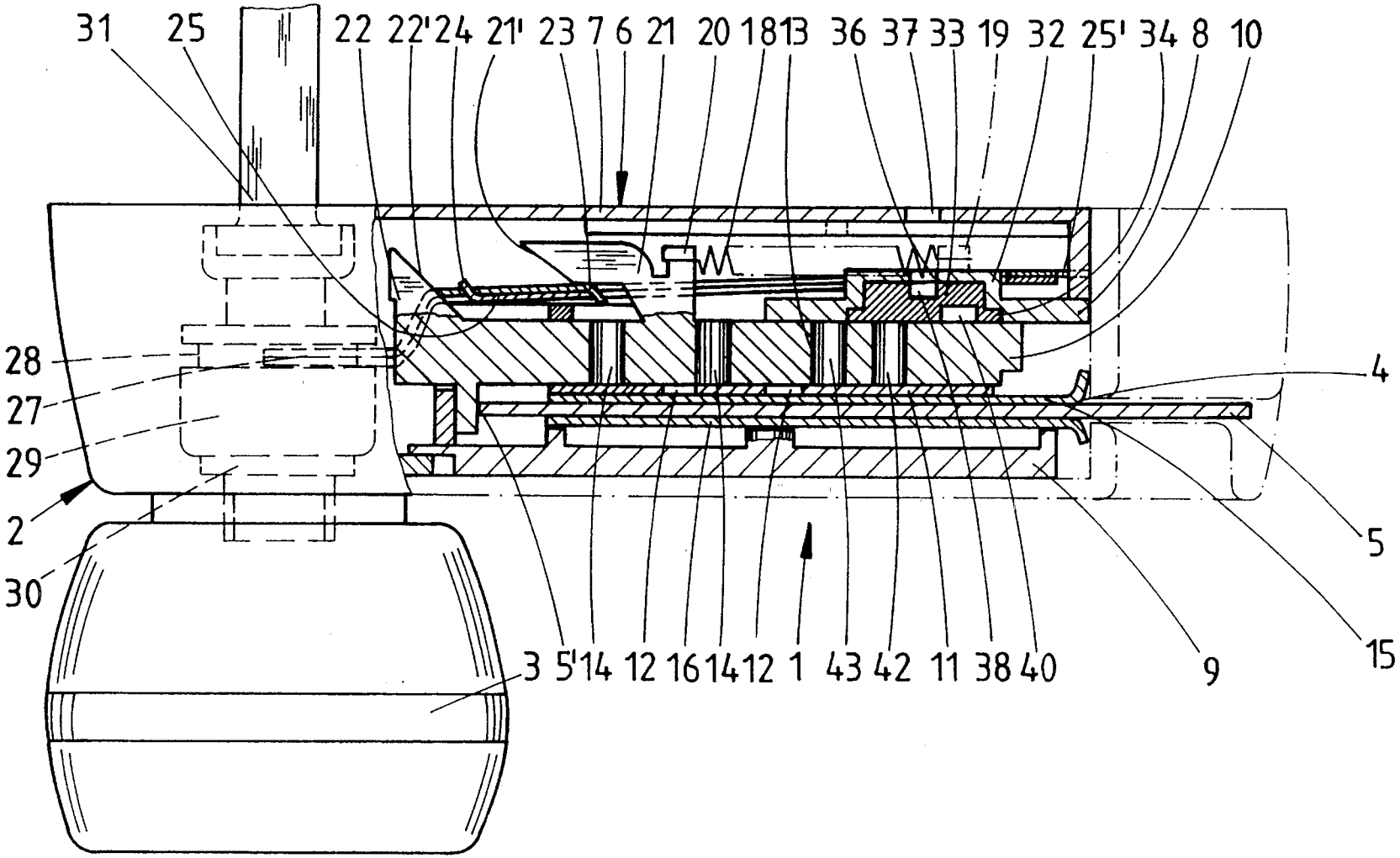
FIG. 3 is a view corresponding to FIG. 2, but with the key inserted and the slide shifted, the outside knob being coupled with the push spindle.
Figure 4:
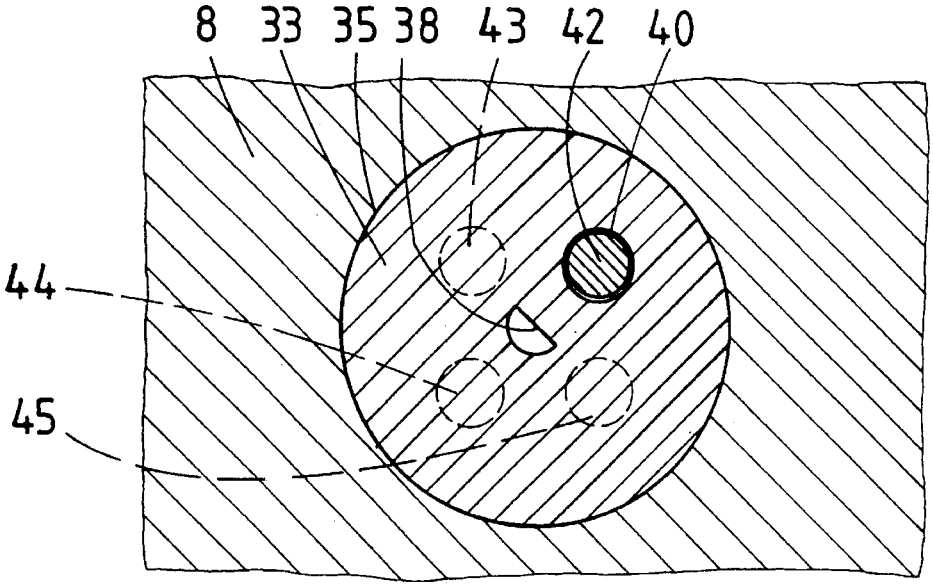
FIG. 4 is a section through the displacement member parallel to the push plane.

In the region of the insertion-side, the middle part 8 forms a dome 32 extending in the direction of the bottom part 7 for receiving a tumbler disk 33. The latter is shaped as an adjusting part and developed in the form of a turnable disk. The tumbler disk 33 or turnable disk has, in the region of its wide surface resting on the slide 10, a radially outwardly protruding collar 34 which lies, in form-fitting manner, in the cavity 35 of the dome 32. In its center, the dome 32 has an insertion opening 36 which is aligned with a passage opening 37 (FIG. 3) through the bottom surface 7' (FIG. 2) of the bottom part 7. To these openings 36, 37 there corresponds a coupling opening 38 of profiled cross section in the tumbler disk 33 for a bar-shaped tool 39 shown in dashed line in FIG. 2. By means of it, the disk-shaped tumbler disk 33 can be rotated in 90° steps. By means of detent means (not shown), the angular positions of the tumbler disk 33 can be fixed.

In accordance with the first embodiment, shown in Figs. 1 to 4, the tumbler disk 33 has a tumbler insertion opening 40 on its wide surface facing the slide 10. With said opening there is aligned a recoding magnet 42 which is guided in a transverse hole 41 in the slide 10. This magnet is developed in the form of a bar-shaped permanent magnet like the other tumbler pins 14. The length of the recoding magnet corresponds to the thickness of the slide 10. The recoding magnet 42 does not engage in an opening in the blocking plate 11, but rests on the facing wide surface thereof.

In addition to the recoding magnet 42 there are other recoding magnets 43, 44, 45 which are grouped on the same pitch diameter around the axis of rotation of the tumbler disk 33. The angular distance between the individual recoding magnets is 90°. The recoding magnets 43, 44, 45 which are also arranged in corresponding transverse holes 41 in the slide 10 also have a length at least equal to the thickness of the slide 10.

The manner of operation is as follows:

In order to be able to actuate the lock 1 from the outside of the door by the use of the outside knob 3, it is necessary to introduce the properly coded key card 5 into the key-card insertion slot 4. By this, the armature plate 16, which is acted on by the compression springs 17, is displaced in transverse direction. In the completely inserted position of the key card 5, the insertion-side end edge 5' of the key card 5 comes in front of a slide stop 10' facing in the direction of the cover part 9. In this position, the magnetic tumbler pins 14 are so displaced that they leave the holes 12 in the blocking plate 11. In this inserted position, the recoding magnet 42 lies opposite a magnetized region of the key card 5, which region acts to attract it. The recoding magnet 42 therefore does not enter into the tumbler-member insertion opening 40 of the tumbler disk 33 or turnable disk. The key card 5 can now be moved further, the slide 10 being driven against the force of the tension spring 18. With the forward displacement of the slide 10, its nose 21 strikes against the arm 25 which swings around its spring zone 25'; see FIG. 3. Since the free, forked end 27 of the arm 25 is in engagement with the coupling sleeve 29, the latter is pushed in such a manner that it then grips over the pinion 30. In this way, a turning connection with the push spindle 31 is brought about, so that actuation of the outside knob 3 leads to a displacement of a bolt which is coupled to the push spindle 31.

It is not shown in the drawing that the slide 10 is detent-engaged in its forward-displaced position. This detent engagement is eliminated only upon the removal of the key card 5. The slide 10 is then moved back into its starting position by the tension spring 18. During this process, the coupling sleeve 29 is moved back in the manner that the other nose 22 of the slide 10 acts on the tab 24 of the arm 25 and thus moves the arm 25 back into its end position.

The tool 39 is employed in order to change the locking code. By means of this tool 39, which can be inserted through the bottom surface 7' of the lock housing 6, the turnable disk 33 can be turned for instance by 90° in counterclockwise direction. The recoding magnet 43 is then aligned with the tumbler-member insertion opening 40, whereby it performs the task of an active recoding magnet. The manner of operation is basically that the key which is the valid key at the time is coded by attraction at the correct position, while the three other positions are always coded in repulsion. In this way, upon actuation with an incorrect key, the recoding magnet valid at the time is brought in blocking manner into the insertion opening 40.

Figure 5:
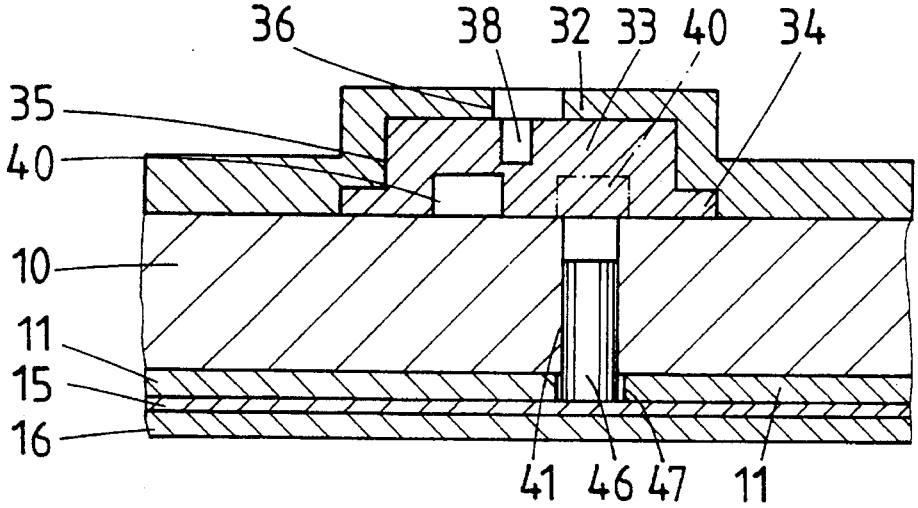
FIG. 5 shows a portion of the lock in the region of the adjusting member, in the case of a modified embodiment.

In accordance with the embodiment of FIG. 5, the recoding magnet 46 engages into a hole 47 in the blocking plate 11. The length of the recoding magnet 46 corresponds to the thickness of the slide 10. In accordance with the position shown in FIG. 5, no tumbler insertion opening 40 is opposite the recoding magnet 46. Upon the use of a proper key card, the recoding magnet 46 is therefore also lifted out of the hole 47 in the blocking plate 11, so that the slide 10 is displaceable. If a stepwise turning of the tumbler disk 33 is brought about so that the tumbler-member insertion opening 40 comes into the position shown in dashed line, then the key 5 effects a displacement of the recoding magnet 46, which then engages in blocking manner into the tumbler insertion opening 40. In this way, all subsequent keys are excluded, regardless of how the key is magnetized in the region opposite the recoding magnet 46. Thus, for instance, the guest has the possibility, from the inside of the room, of blocking out all keys.

The insertion openings may differ in depth as shown in FIG. 7 by the two insertion openings 40 and 40'.

Figure 6:
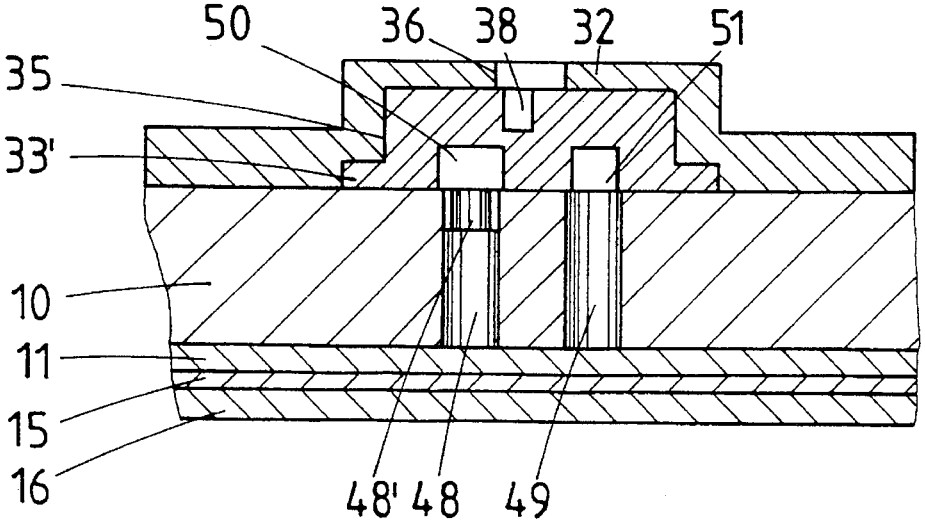
FIG. 6 shows a further variant within the region of the adjusting member.

In accordance with FIG. 6, two recoding magnets 48, 49 lie one behind the other in the direction of displacement of the slide 10. The two are aligned with tumbler insertion openings 50, 51 of the tumbler disk 33'. The insertion opening 51 is of smaller diameter than the recoding magnet 49 opposite it. On the other hand, the recoding magnet 48 can engage with its stepwise reduced shoulder 48' into the tumbler insertion opening 50. The key card which effects the locking must be of such a nature that it does not effect a displacement of the recoding magnet 48. The slide 10 can then, by means of the key card, be displaced forward unimpeded.

If the closing code is to be changed, then the tumbler disk 33' is to be displaced in such a manner by the tool 39 that the insertion opening 51 comes opposite the recoding magnet 48 and the insertion opening 50 opposite the recoding magnet 49. If a key which does not have properly polarized regions is now used, the recoding pin 48' can enter into the insertion opening 51. This applies also to the recoding magnet 49, which then engages into the insertion opening 50.

I claim:

1. A closure system composed of a lock and several keys, in which a closing of the lock is determined by magnetically controlled tumblers, and wherein the closing of the lock can be modified by a change of a closure code of the lock, said several keys including a first key and subsequent keys each of which has magnetized regions, the lock comprising a plurality of permanent magnets, a slide having openings for receiving individual ones of said magnets, a blocking plate for engagement with individual ones of said magnets to provide blocking positions whereby the blocking plate blocks movement of said slide, means for receiving said first key and allowing the key to be brought into position parallel to said slide for magnetically urging individual ones of said magnets to be displaced in a direction transverse to the direction of movement of said slide, and a tumbler disk having a face parallel to a plane of movement of said slide and having within said face insertion openings for receiving individual ones of said magnets;

wherein said tumbler disk is rotatable relative to said slide for admitting and excluding insertion of various ones of said magnets into said insertion openings;

said lock is operable with said subsequent keys wherein said subsequent keys have arrays of magnetized regions different from each other and from an array of the magnetized regions of said first key, each of said keys being operative with an individual closure code;

the closure code of the lock corresponds initially to the code of said first key and can be varied by a repositioning of said tumbler disk within the lock to the code of one of said subsequent keys;

the closure code of the lock is formed by individual ones of said permanent magnets which are arranged in the openings of said slide and are displaceable out of their blocking positions with respect to said blocking plate by means of correspondingly positioned ones of said magnetized regions of one of said keys which is brought into its position parallel to said slide;

said slide is displaceable into a lock-open position, and a portion of said permanent magnets are developed as recoding magnets; and said tumbler disk is developed as an adjusting part associated with individual ones of the recoding magnets in the manner that an insertion opening of said disk for an individual one of said recoding magnets is displaceable out of an aligned position of a respective individual recoding magnet.

2. A lock according to claim 1, wherein said adjusting part has a plurality of insertion openings of different dimensions of diameter and/or depth.

3. A lock according to claim 1, wherein at least one of said recoding magnets corresponds in its length to the thickness of said slide and is lifted out of its blocking position with respect to said blocking plate upon striking against a wide surface of said adjusting part.

4. A lock according to claim 1, wherein said lock has a housing, and said tumbler disk is rotatable and is adjustable with respect to an angle of its rotation by means of a tool which can be inserted through a bottom surface of said lock housing.

5. A lock according to claim 1, wherein said insertion openings of said tumbler disk have differing dimensions, and end regions of said magnets have differing dimensions to permit entry into respective ones of said insertion openings.

* * * * *